US011293137B2

(12) United States Patent
Su et al.

(10) Patent No.: US 11,293,137 B2
(45) Date of Patent: Apr. 5, 2022

(54) METHOD OF MANUFACTURING BLEND COMPOSITION

(71) Applicant: Zig Sheng Industrial Co., Ltd., Taoyuan (TW)

(72) Inventors: Pai-Huang Su, Taoyuan (TW); Hsueh-Chou Shih, Taoyuan (TW); Yu-Tang Lin, Taoyuan (TW); Chun-Jun Xu, Taoyuan (TW); Rung-Tzung He, Taoyuan (TW)

(73) Assignee: Zig Sheng Industrial Co., Ltd., Taoyuan (TW)

( * ) Notice: Subject to any disclaimer, the term of this patent is extended or adjusted under 35 U.S.C. 154(b) by 12 days.

(21) Appl. No.: 16/924,601

(22) Filed: Jul. 9, 2020

(65) Prior Publication Data

US 2020/0340173 A1 Oct. 29, 2020

Related U.S. Application Data

(62) Division of application No. 16/102,872, filed on Aug. 14, 2018, now Pat. No. 11,220,782.

(30) Foreign Application Priority Data

Feb. 14, 2018 (TW) ..... 107105668

(51) Int. Cl.
*D06M 14/16* (2006.01)
*D06N 3/00* (2006.01)
(Continued)

(52) U.S. Cl.
CPC ..... *D06M 14/16* (2013.01); *D06N 3/0018* (2013.01); *D06M 2101/14* (2013.01); *D06M 2101/34* (2013.01)

(58) Field of Classification Search
CPC ..... C08J 2389/06; C08L 89/06; C08L 77/02; D01F 6/90; D01F 6/60; D06M 14/16;
(Continued)

(56) References Cited

U.S. PATENT DOCUMENTS 2,289,775 A * 7/1942 Graves ..... C08L 89/005 524/501

FOREIGN PATENT DOCUMENTS

| | | | |
|---|---|---|---|
| CN | 106567252 | | 4/2017 |
| CN | 107164970 | | 9/2017 |
| GB | 1367490 | * | 9/1974 |

OTHER PUBLICATIONS

Nylon 6, Wikipedia, accessed online Sep. 16, 2020.*
(Continued)

*Primary Examiner* — Camie S Thompson
(74) *Attorney, Agent, or Firm* — Servilla Whitney LLC

(57) ABSTRACT

A method of manufacturing a blend composition, comprising: providing caprolactam; heating the caprolactam to a temperature of about 215° C. to about 280° C. for polymerization to form polycaprolactam; and mixing the polycaprolactam at the temperature of about 215° C. to about 280° C. with collagen, such that the collagen is denatured by heat, wherein the denatured collagen has a first polypeptide, a second polypeptide, and third polypeptide, and amide groups of the first polypeptide, the second polypeptide, and the third polypeptide are linked with amide groups of the polycaprolactam through hydrogen bond formation, thereby the blend composition is formed.

6 Claims, 3 Drawing Sheets

(51) Int. Cl.
*D06M 101/34* (2006.01)
*D06M 101/14* (2006.01)

(58) Field of Classification Search
CPC ..... D06M 2101/14; D06M 2101/34; C08G 69/36; B32B 2377/00; B32B 27/34; C09D 177/02; C09D 177/06
USPC ..... 428/292.1, 299.7; 430/628, 60.7; 524/20, 21, 22; 525/54.1; 530/356, 354
See application file for complete search history.

(56) References Cited

OTHER PUBLICATIONS

Aminocaproic acid, accessed online Sep. 6, 2020.*
Nylon 6, Wikipedia, accessed online Sep. 16, 2021.*
Aminocaproic acid, Wikipedia, accessed online Sep. 16, 2021.*

* cited by examiner

METHOD OF MANUFACTURING BLEND COMPOSITION

CROSS-REFERENCE TO RELATED APPLICATIONS

The present application is a Divisional Application of the U.S. application Ser. No. 16/102,872, filed Aug. 14, 2018, which claims priority to Taiwan Application Serial Number 107105668, filed on Feb. 14, 2018, all of which are herein incorporated by reference in their entireties.

BACKGROUND

Field of Invention

The present disclosure relates to a composition, in particular to a blend composition having collagen.

Description of Related Art

Collagen, like other proteins, is composed of 20 different amino acids. Although the amino acid compositions of collagens in different organisms are different, the common characteristic is that glycine accounts for almost ⅓ of the amino acid content in collagen. The structures of collagen molecules are also very special. Each collagen has three polypeptide chains. The secondary structure of each main polypeptide chain is a helix. The three polypeptide chains further tangle together to form a special triple helix structure.

Common synthetic fibers are fibers such as polyolefins, polyesters, polyamides and the likes. Although synthetic fibers are more excellent in dehumidifying property than natural fibers, synthetic fibers in dresses are apt to cause discomfort feeling such as sultry due to the problem of hydrophobicity. Moreover, due to the difficulties in the manufacturing process, no one has been able to make textiles blended with collagen and synthetic fibers. Accordingly, it is an urgent need to develop the blend fibers that are stable in quality and suitable for mass production.

SUMMARY

One aspect of the present disclosure is a blend composition including polyamide fiber and denatured collagen. The content of the polyamide fiber is 97 parts by weight to 99.9 parts by weight in the blend composition. The content of the denatured collagen is 0.1 to 3 parts by weight in the blend composition, wherein the denatured collagen has a first polypeptide a second polypeptide, and a third polypeptide. The amide groups of the first polypeptide, the second polypeptide, and the third polypeptide are linked with the amide groups of the polyamide fiber through hydrogen bond formation.

According to some embodiments of the present disclosure, the polyamide fiber is selected from the group consisting of polyamide 6, polyamide 66, polyamide 6/66, polyamide 6/612, polyamide 6/6T, and polyamide 6/6I.

It is to be understood that both the foregoing general description and the following detailed description are by examples, and are intended to provide further explanation of the present disclosure.

According to some embodiments of the present disclosure, the denatured collagen is selected from the group consisting of denatured bovine collagen, denatured porcine collagen, denatured fish collagen, and denatured human collagen.

According to some embodiments of the present disclosure, the weight-average molecular weight of the denatured collagen is 900 Da to 11000 Da.

According to some embodiments of the present disclosure, the Yellow index (YI) of the blend composition is about 19 to about 24.

According to some embodiments of the present disclosure, the Relative viscosity (RV) of the blend composition is about 2.4 to about 2.5.

According to some embodiments of the disclosure, the concentration of the denatured collagen is about 560 μg/g to about 990 μg/g.

One aspect of the present disclosure is a method of manufacturing a blend composition, the method includes: providing caprolactam; heating the caprolactam to a temperature of about 215° C. to about 280° C. for polymerization to form polycaprolactam; and mixing polycaprolactam at a temperature of about 215° C. to about 280° C. with collagen, thereby the collagen is denatured by heat, the denatured collagen has a first polypeptide, a second polypeptide, and a third polypeptide, and the amide groups of the first polypeptide, the second polypeptide, and the third polypeptide are linked with the amide groups of the polycaprolactam through hydrogen bond formation, thereby the blend composition is formed. According to some embodiments of the present disclosure, the step of providing caprolactam includes providing caprolactam in an amount of 97 parts by weight to 99.9 parts by weight.

According to some embodiments of the present disclosure, the step of mixing polycaprolactam at a temperature of about 215° C. to about 280° C. with collagen includes: mixing polycaprolactam at a temperature of about 215° C. to about 280° C. with collagen which is in an amount of 0.1 to 3 parts by weight.

According to some embodiments of the present disclosure, the step of heating caprolactam to a temperature of about 215° C. to about 280° C. for polymerization to form polycaprolactam includes heating caprolactam at a temperature of about 215° C. to about 285° C. and at a pressure of about 3 bars for about 3 to about 5 hours to form polycaprolactam.

One aspect of the present disclosure is a method of manufacturing a blend composition, the method includes: providing caprolactam; providing collagen; mixing caprolactam with collagen to form a mixture; and heating the mixture to a temperature of about 215° C. to about 280° C. for polymerization of the caprolactam in the mixture to form polycaprolactam and denaturing the collagen in the mixture with heat to form denatured collagen, wherein the denatured collagen has a first polypeptide, a second polypeptide, and a third polypeptide, and the amide groups of the first polypeptide, the second polypeptide, and the third polypeptide are linked with the amide groups of the polycaprolactam through hydrogen bond formation, thereby the blend compositon is formed.

According to some embodiments of the present disclosure, the step of providing caprolactam includes providing caprolactam in an amount of 97 parts by weight to 99.9 parts by weight.

According to some embodiments of the present disclosure, the step of providing collagen includes providing collagen in an amount of 0.1 to 3 parts by weight.

One aspect of the present disclosure is a method of manufacturing a blend composition, the method includes:

providing polyamide 6; heating the polyamide 6 to a temperature of about 215° C. to about 280° C. to form liquid polyamide 6; and mixing the liquid polyamide 6 at a temperature of about 215° C. to about 280° C. with collagen to denature the collagen by heat, the denatured collagen has a first polypeptide, a second polypeptide, and a third polypeptide, and the amide groups of the first polypeptide, the second polypeptide, and the third polypeptide are linked with the amide groups of the liquid polyamide 6 through hydrogen bond formation, thereby the blend compositon is formed.

It is to be understood that both the foregoing general description and the following detailed description are by examples, and are intended to provide further explanation of the invention as claimed.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
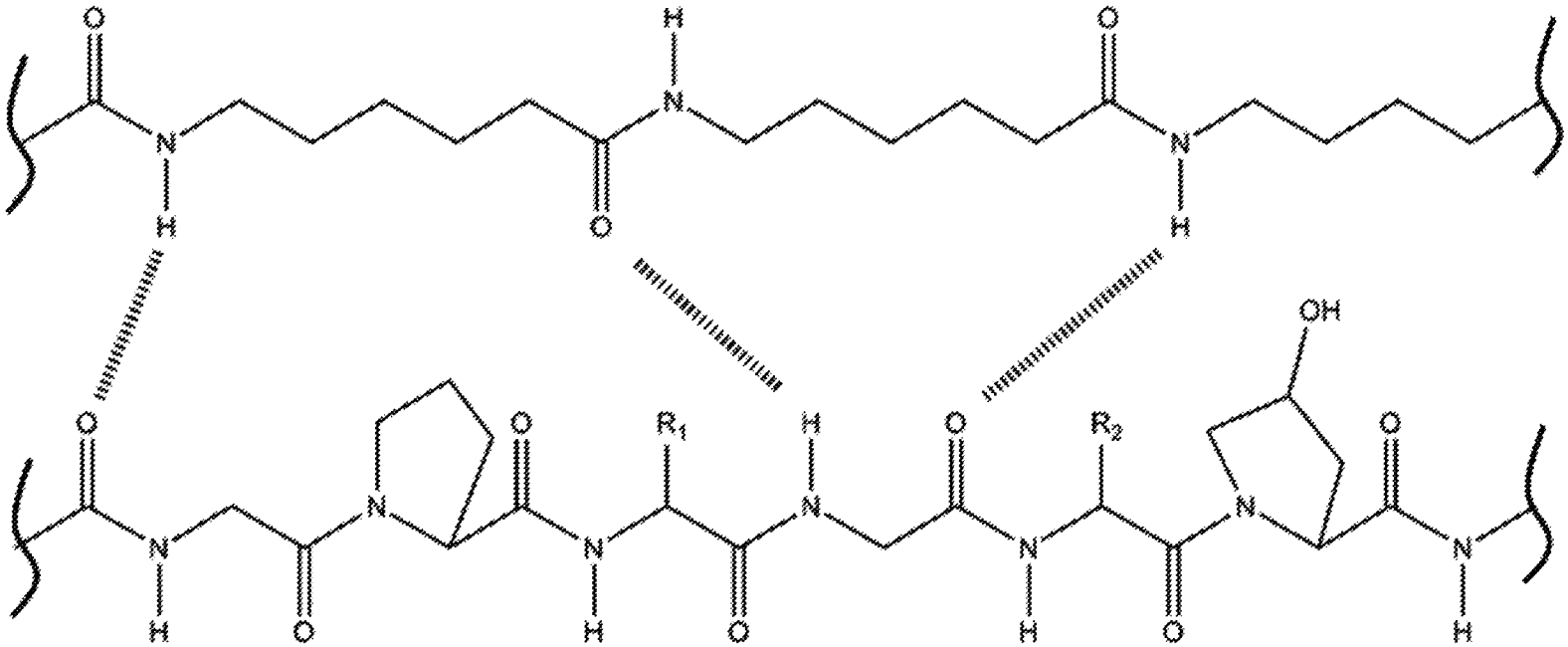
FIG. 1 is a schematic diagram illustrating the bonding between a portion of the polyamide fiber and a portion of the polypeptides, according to some embodiments of the present disclosure.

In order to make the description of the present disclosure more detailed and complete, a description of the embodiments and examples is provided; however, this is not the only way for implementing or applying the examples. The examples disclosed below can be combined or replaced with each other in a beneficial situation, and other examples can also be added into an example without further description or explanation. In the following description, numerous specific details are provided in order to provide a thorough understanding of the following examples. However, examples of the present disclosure may be carried out without such specific details.

As used herein, the singular forms "a", "an" and "the" are intended to include the plural forms as well, unless the context clearly indicates otherwise. It will be further understood that the terms "comprises", "includes", "has", and the likes when used in this application, specify the presence of stated features, regions, integers, steps, operations, elements, and/or components, but do not preclude the presence or addition of one or more other features, regions, integers, steps, operations, elements, components, and/or groups thereof.

The term "denatured", as used herein, relates to protein denaturation, which means the original structure or configuration of proteins are changed by certain physical or chemical factors. For example, for collagen, which basic structure consists of three polypeptides intertwined tightly with each other by hydrogen bonds, van der Waals forces, and ionic bonds to form a triple-helix structure. After denaturation of the collagen, the three polypeptides of the denatured collagen become an unfolded state. That is, the three polypeptides after denaturation are independent of each other and are not entangled together. For example, heating causes thermal denaturation of collagen, therefore, unravels the three-helix structure wrapped by three polypeptides.

The blend composition of the examples of the present disclosure includes polyamide and denatured collagen. The polyamide fiber accounts for 97 parts by weight to 99.9 parts by weight in the blend composition. The denatured collagen accounts for 0.1 to 3 parts by weight in the blend composition. The denatured collagen has a first polypeptide, a second polypeptide, and a third polypeptide, and the amide groups of the first polypeptide, the second polypeptide, and the third polypeptide are linked with the amide groups of the polyamide fiber through hydrogen bond formation. In some embodiments, the polyamide fiber is selected from the group consisting of polyamide 6 (Nylon 6), polyamide 66 (Nylon 66), polyamide 56 (Nylon 56), polyamide 610 (Nylon 610), polyamide 6/612 (Nylon 6/612), polyamide 6/6T (Nylon 6/6T), and polyamide 6/6I (Nylon 6/6I). In some embodiments, the denatured collagen is selected from the group consisting of denatured bovine collagen, denatured porcine collagen, denatured fish collagen, and denatured human collagen.

FIG. 1 is a schematic diagram illustrating the bonding between a portion of the polyamide fiber and a portion of the polypeptides, according to some embodiments of the present disclosure. The upper polymer chain in FIG. 1 is a portion of polyamide 6, and the lower polymer chain in FIG. 1 is a partial peptide fragment of a polypeptide of collagen, wherein R1 and R2 may be the residue of any amino acids (e.g. the residue of Glycine; hydrogen). Specifically, the basic structure of collagen includes three polypeptides, and the three polypeptides are tightly tangled with each other to form a triple-helix structure through hydrogen bonds, van der Waals forces, or ion bonds. In the blend composition of the examples of the present disclosure, the three polypeptides of the denatured collagen are unfolded. In other words, the three denatured polypeptides of the collagen are independently an evenly dispersed in the blend composition. Further, a polypeptide is formed by linking many peptides via peptide bonds, therefore, a polypeptide has many amide groups. These amide groups of the polypeptides further form hydrogen bonds and tightly bond to the amide groups of the polyamide fiber. It is noted, it may also be suitable using various collagen with various molecular weight for the blend composition of the embodiment. In some embodiments, the weight-average molecular weight of the denatured collagen is 900 Da to 11000 Da. In some embodiments, the weight-average molecular weight of the denatured collagen is 900 Da to 2100 Da. In some embodiments, the weight-average molecular weight of the denatured collagen is 4500 Da to 11000 Da. In some embodiments, the weight-average molecular weight of the denatured collagen is 1500 Da to 5500 Da. In some embodiments, when the weight-average molecular weight of the collagen is greater than 11000 Da, the steric hindrance of the groups of the collagen may affect the blending manufacturing process, resulting in the time too long for blending or even blending failure.

In order to ensure the quality of the blend composition, various parameters are used to evaluate the blend composition in the present embodiment. For example, Yellow index generally refers to the degree of yellowing of a product. According to some aspects of the present embodiment, the yellowing is caused by the oxidation of the blend composition during the manufacturing process; therefore, if the Yellow index is too high, the quality of the product is poor. Among the current manufacturing processes, no one can blend polyamide polymer with collagen to manufacture textiles. In some embodiments, the Yellow index of the blend composition is about 18 to about 55. In some embodiments, the Yellow index of the blend composition is about 25 to about 56. In some embodiments, the Yellow index of the blend composition is about 25 to about 32. According to some embodiments of the present disclosure, it is unexpectedly discovered that the Yellow index of the blend composition can be stably controlled at about 19 to about 24 after polyamide fiber is blended with collagen. As mentioned above, if the Yellow index is too high (for example, much higher than 24), the quality of the product is poor, which means the blend compositions may have changes in oxidation state or other physicochemical properties during the manufacturing process; these changes may cause problems such as poor fiber elasticity and poor heat resistance. Moreover, in some embodiments, the concentration of the denatured collagen in the blend composition can be stably maintained at 560 μg/g to 990 μg/g. The concentration of the denatured collagen in the blend composition is less than 160 μg/g, which means polypeptides of the denatured collagen degrade into many fragments during the manufacturing process, and the integrity of the protein cannot be maintained, so as the fiber of the blend composition has poor elasticity. Further, stirring equipment is used in the manufacturing process to continuously and evenly stir the polyamide fiber with the collagen during the blending process. If the composition is viscous, it will be unfavorable for stirring. Therefore, in some embodiments, the blend composition has a Relative viscosity (RV) of about 2.4 to about 2.5. In addition, compared to the current synthetic fibers, the various blend compositions of the embodiment can increase the moisture regain of about 0.3 percent to 0.6 percent.

An example of the present disclosure also provides a method of manufacturing a blend composition, wherein the method includes providing caprolactam; heating the caprolactam to a temperature of about 215° C. to about 280° C. for polymerization to form polycaprolactam; and mixing the polycaprolactam at a temperature of about 215° C. to about 280° C. with collagen, such that the collagen is denatured by heat. The triple-helix structure of the denatured collagen is unwounded so that the first polypeptide chain, the second polypeptide, and the third polypeptide are independent of each other and they are not tangled together. Moreover, the amide groups of the first peptide, the second peptide, and the third peptide are linked with the amide groups of the polyamide fiber through hydrogen bond formation, thereby the blend composition is formed.

More specifically, according to the present embodiment, it is unexpectedly discovered that textile with stable quality can be obtained by blending polycaprolactam with a small amount of collagen. Therefore, according to some embodiments, in the case that the total weight percent of the blend composition is 100%, the step of providing caprolactam includes providing caprolactam in an amount of about 97 to about 99.9 weight percent, while the collagen accounts for about 0.1 weight percent to about 3 weight percent. For example, in some embodiments, the step of providing caprolactam includes providing 97 to 99.9 parts by weight of caprolactam. In other embodiments, the collagen accounts for 0.1 to 3 parts by weight. Some collagen will be degraded during the blending process; if the collagen content is too low (e.g. much lower than 0.1 parts by weight), the collagen may be completely degraded during the blending process; thus no intact polypeptide exists in the blend composition. However, if the blending content of the collagen is higher than 3 parts by weight, the blending failure will occur in the manufacturing process. In some embodiments, the collagen accounts for 0.1 to 1 parts by weight. In some embodiments, the collagen accounts for 1 parts by weight to 3 parts by weight.

Further, various parameters during the heating process may be adjusted to optimize the product yield. For example, in some embodiments, the above-mentioned step of mixing polycaprolactam at a temperature of about 215° C. to about 280° C. with collagen includes heating caprolactam at a temperature of about 215° C. to about 285° C. and at a pressure of about 3 bars for about 3 to about 5 hours to form polycaprolactam.

According to examples of the present disclosure, another aspect_provides a method of manufacturing a blend composition, wherein the method includes providing caprolactam; providing collagen; mixing the caprolactam and the collagen to form a mixture; heating the mixture to a temperature of about 215° C. to about 280° C. for polymerization of the caprolactam in the mixture to form polycaprolactam and denaturing the collagen in the mixture with heat to form denatured collagen. The denatured collagen has a first polypeptide, a second polypeptide, and a third polypeptide, and amide groups of the first polypeptide, the second polypeptide, and the third polypeptide are linked with amide groups of the polycaprolactam through hydrogen bond formation, thereby the blend composition is formed. In this embodiment, polycaprolactam may also be blended with a small amount of collagen, and the parameters such as pressure and heating time may be the same as the parameters of the method of the aforementioned blend composition. However, in the present embodiment, the ring-opening polymerization of caprolactam is performed simultaneously with the mixing of collagen. In other words, collagen is mixed with caprolactam at a temperature of about 215° C. to about 280° C. for a period (e.g. 3 to 5 hours), until the polymerization of caprolactam into polycaprolactam.

According to the examples of the present disclosure, another aspect provides a method of manufacturing a blend composition, wherein the method includes providing polyamide 6; heating the polyamide 6 to a temperature of about 215° C. to about 280° C. to form liquid polyamide 6; and mixing the liquid polyamide 6 at a temperature of about 215° C. to about 280° C. with collagen to denature the collagen with heat, the denatured collagen has a first polypeptide, a second polypeptide, and a third polypeptide, and amide groups of the first polypeptide, the second polypeptide, and the third polypeptide are linked with amide groups of the liquid polyamide 6 through hydrogen bond formation, thereby the blend composition is formed. In this method, the blended composition of the present embodiment can also be obtained directly from a commercially available polyamide 6 (nylon 6). In other words, polyamide 6 can be heated and melted at the aforementioned high temperature, and then the high temperature is applied in mixing the collagen to form the blend composition.

In order to demonstrate that the aforementioned blend compositions can be made by the method according to the embodiments of the present disclosure, the following experiments are performed. It should be noted that the following embodiments are provided only for the purpose of illustration and do not limit the present disclosure.

The evaluation indicators used in the examples are described below.

The content of organic matter (OM) in the water extracts 25 grams of the sample was added to 100 ml of pure water and was cooked for 8 hours at the temperature of 98° C. Then, the sample was cooled down to room temperature and was filtered with a mesh to remove impurities and the filtrate was left. The filtrate was analyzed by Total Organic Carbon (TOC) Analyzer to obtain the TOC value (ppm), and the weight percentage of TOC in the sample can be obtained by calculation.

Yellowness index (YI)

This indicator is mainly used to evaluate the degree of deviation from white or the degree of yellowing for colorless, translucent or near-white polymer materials. The magnesium oxide white board under the standard light source is used as a standard, the samples were measured with a colorimeter, a color difference meter, or a spectrophotometer, and the reflectance (or transmittance) of the samples of the red, green, and blue light is respectively calculated to obtain a measure illustrating the degree of yellow. This experiment is carried out in accordance with ASTM E313 test standard, wherein X,Y, and Z in the formula represents the RGB values of the color of the material under the standard light source.

Relative viscosity (RV)

This test for the relative viscosity of the samples is carried out in accordance with ASTM E313 test standard. 0.22±0.005 g of the sample was placed in a flask, and 96% concentrated sulfuric acid was added to dissolve the sample. Ostwald Viscometer was used to measure the viscosity of the samples, and the relative viscosity was calculated according to the following formula (1):

$$\eta_{rv} = \frac{t_1}{t_0} \tag{1}$$

$\eta_{rv}$ is the relative viscosity. $t_1$ is the flow time of the sample through the Oswald Viscometer. $t_0$ is a blank control group, that is, the flow time of concentrated sulfuric acid through the Oswald Viscometer.

Analysis of terminal amine group 0.5 g of the sample was weighted (with an accuracy of 0.1 mg), placed into a plastic cup for titration, and 40 ml of a mixture of phenol and methanol was added as a solvent. Next, the plastic cup was transferred to an automatic titrator and 0.05 N of $HClO_4$ was used for titration. The titration curve was drawn by the automatic titrator, and the equivalent point in the titration curve was determined by a tangent method to determine the consumed volume of perchloric acid. The content of the terminal amine group can be calculated by the following formula (2):

$$(-NH_2)\ \text{meq/kg} = \frac{(A-B)\times N\times 1000}{W} \tag{2}$$

—$NH_2$ is the content of the terminal amine group. A is the consumed $HClO_4$ volume (mL) for titration of the sample solution. B is the consumed $HClO_4$ volume (mL) for titration of the solvent, which is the blank control group. N is the equivalent concentration of $HClO_4$ (eq/L). W is the weight (g) of the sample.

The blend compositions of this experiment can be classified as being made from two different manufacturing system according to the time point of collagen adding. Please continue to refer to the following description.

Blending collagen during the polymerization of the amide compounds (Internal addition system).

In this system, the amide compound was caprolactam, and the collagen was purified from fish scale waste. Caprolactam and collagen were added to a stirred tank, the temperature was adjusted to about 240° C. to about 255° C., the pressure was adjusted to 3 bars, and the stirring time was about 3 to about 5 hours. Under such high temperature and pressure, the caprolactam underwent ring-opening polymerization to form polyamide 6, the three-helix structure of the collagen was unwound because the collagen was denatured by high temperature; further, the caprolactam and the collagen mixed evenly because of stirring, and they are rebonded together through hydrogen bonds. Referring to Table 1 below, it shows the experimental result for various weight percentages of collagen.

TABLE 1

| example | collagen (Mw is 10 KDa) | Relative viscosity | Terminal amine group (meq/kg) | Yellow index | Content of Organic matter (%) |
|---|---|---|---|---|---|
| Control | — | 2.46 | 45.0 | 3.07 | 0.26 |
| Example 1 | 0.2% | 2.46 | 57.0 | 27.16 | 0.38 |
| Example 2 | 0.5% | 2.43 | 47.2 | 39.72 | 0.42 |
| Example 3 | 1.0% | 2.4 | 42.3 | 48.19 | 0.40 |
| Example 4 | 2.0% | 2.3 | 37.4 | 54.34 | 0.43 |
| Example 5 | 3.0% | | failure | | |

Figure 2:
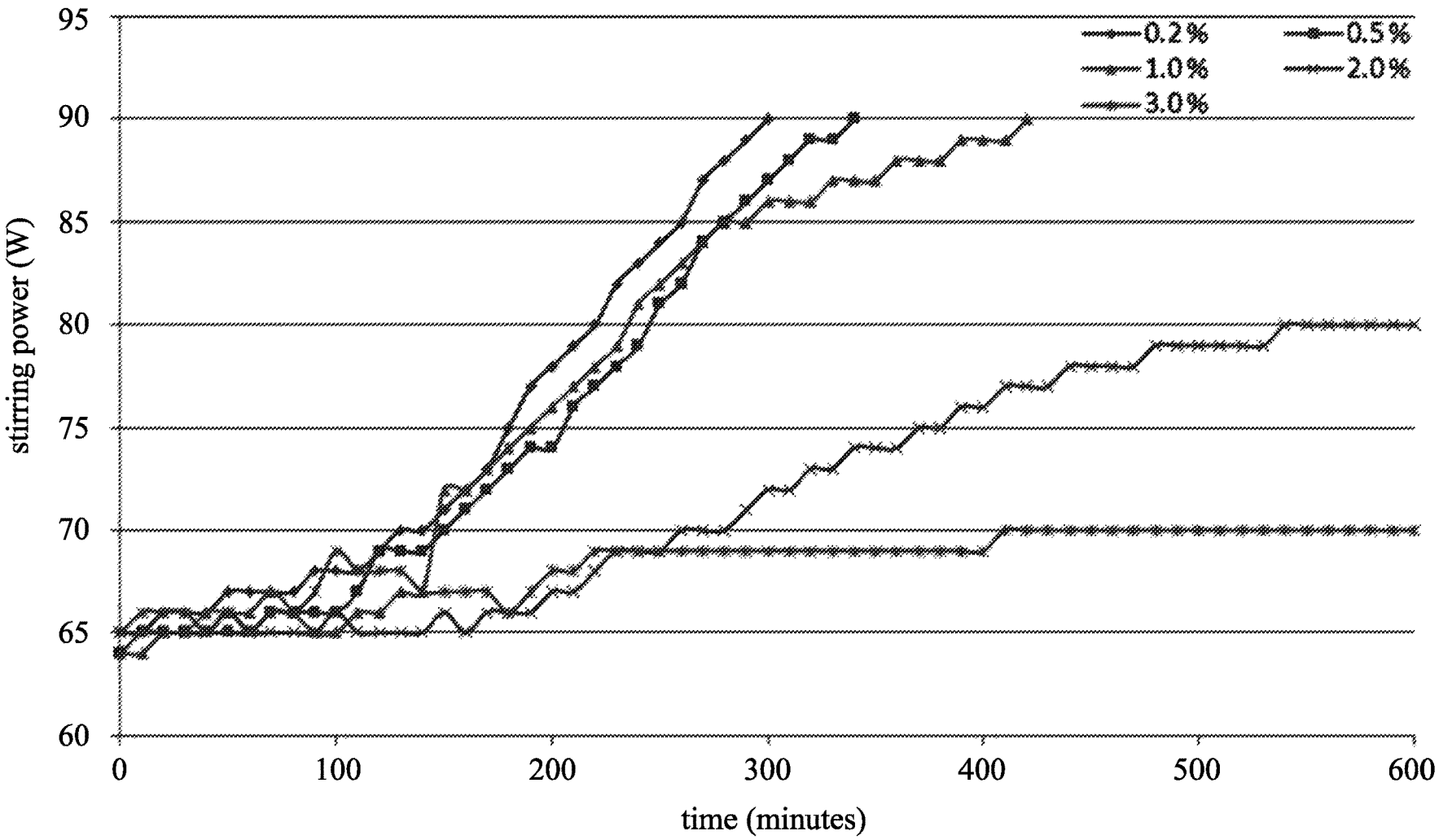
FIG. 2 is a figure showing the results of the blending process of Example 1 to Example 5, according to some embodiments of the present disclosure.

In the control group, only caprolactam was added to the stirring equipment, and collagen was not blended with caprolactam during the polymerization of caprolactam. In Example 1 to Example 5, caprolactam and collagen were simultaneously added to the stirring equipment for the aforementioned blending, and all of the weight-average molecular weights of the selected collagens are 10KDa. The difference among the different examples is that the respective collagen contents in Example 1, Example 2, Example 3, Example 4, and Example 5 are 0.2%, 0.5%, 1.0%, 2.0%, and 3.0%, while the total weight percentage of the blend composition is 100%. The stirring power was the indicator for determining the completeness of blending. Specifically, the viscosity increases as the polymerization degree of the mixture increase during the blending process; accordingly, greater stirring power is required. Therefore, the threshold for the completeness of the blending process is set to be greater than 75 W of stirring power, according to the stirring equipment of the embodiment. Referring to FIG. 2, which shows the results of the blending process in Example 1 to Example 5. The vertical axis shows stirring power (W), and the horizontal axis shows stirring time (minutes). When the collagen contents were 0.2% (Example 1), 0.5% (Example 2), and 1.0% (Example 3), all of the stirring power of the examples could be greater than 75 W, and rose to 90 W during about 300 minutes to about 400 minutes of the stirring time. When the collagen content was 2% (Example 4), the stirring power could be greater than 75 W, but it remained near 80 W during 500 minutes to 600 minutes of the stirring time. When the collagen content was 3% (Example 5), the stirring power was unable to reach 75 W, and it remained near 70 W after 400 minutes of continuously stirring. Still referring to table 1, when the collagen content was about 3%, the blending failure occurs. In Example 1 to Example 4, as the collagen content was lower, the terminal amine group, Yellowing index, and content of organic matter tended to decrease significantly. In particular, in Example 1, the terminal amine group was 57 meq/kg, which is significantly higher than the terminal amine group in Example 1 to Example 4; this means in Example 1, fewer polypeptides of collagen were destroyed or degraded, so as the polypeptides integrity can be maintained without excessive free terminal amine groups. Next, the Yellow indexin Example 1 was 27.16, which was also significantly lower than that in Example 2 to Example 4. It is assumed that when the collagen content is below 0.2%, the yellowing degree of the textile is less, resulting in better quality products. Further, the content of organic matter in Example 1 was 0.38%, which was also significantly lower than that in Example 2 to Example 4. As mentioned above, the content of organic matter was determined by a Total Organic Carbon Analyzer. The higher the measured value, the higher the organic matter in the water; that is, the more serious the organic pollution is. However, in Example 1, there was less organic matter content in the water extracts. In other words, when the fabric of Example 1 is applied to textiles, it is more environmentally friendly at each water wash.

In summary, in the internal addition system, the amount of collagen significantly affects the quality of the blend composition.

In the present embodiment, referring to the amount of collagen in Example 1, the effects of the size of the collagen molecule for blend compositions were further tested under the same amount of collagen content (0.2%).

TABLE 2

| example | collagen (accounts for 0.2%) | Relative viscosity | Terminal amine group (meq/kg) | Yellow index | Content of Organic matter (%) |
|---|---|---|---|---|---|
| Example 6 | 10 KDa | 2.46 | 57.0 | 27.16 | 0.38 |
| Example 7 | 5 KDa | 2.41 | 63.2 | 28.35 | 0.36 |
| Example 8 | 2 KDa | 2.52 | 64.4 | 30.08 | 0.42 |
| Example 9 | 1 KDa | 2.43 | 65.2 | 31.11 | 0.44 |

Figure 3:
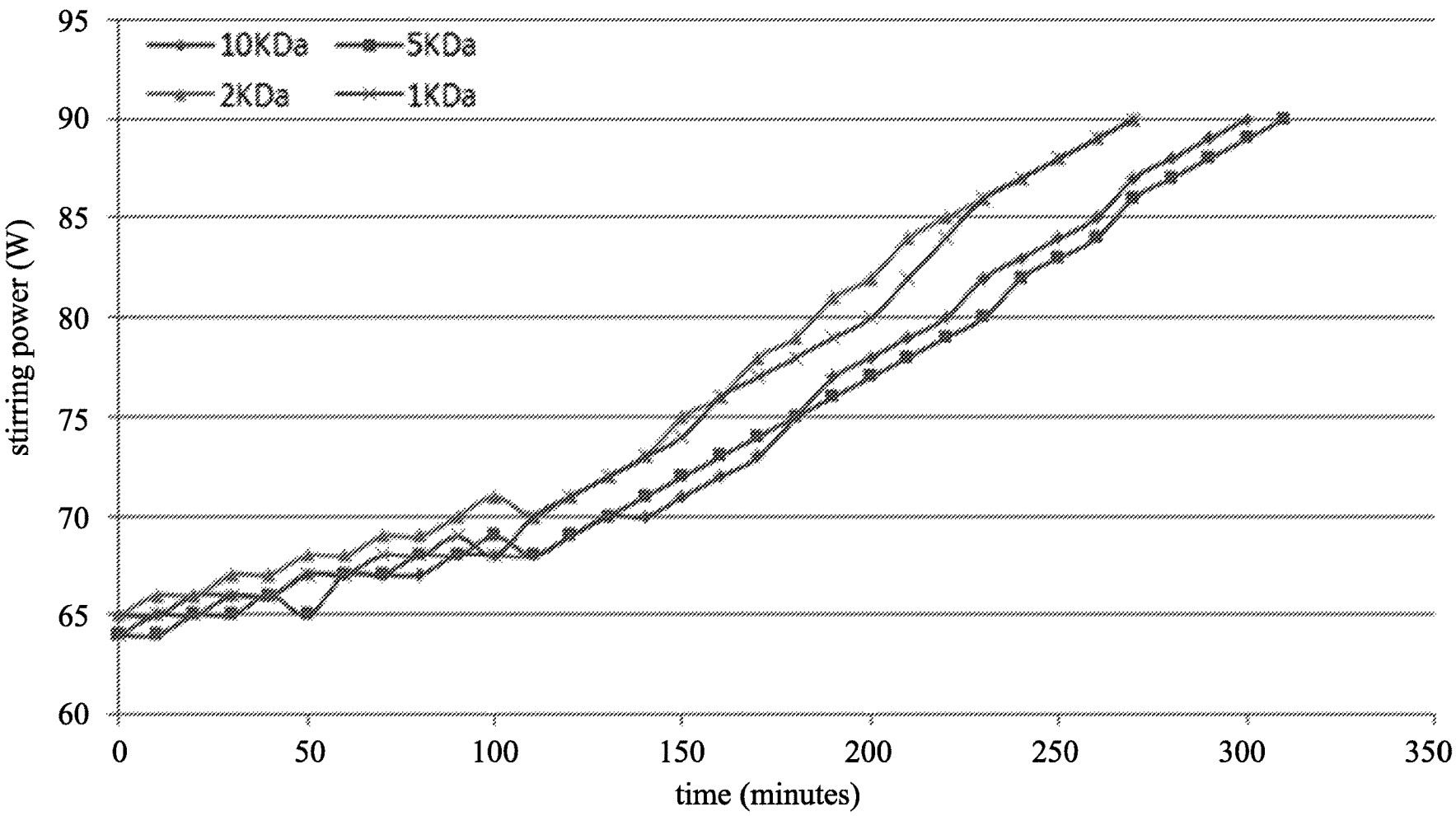
FIG. 3 is a figure showing the result of the blending process of Example 6 to Example 10, according to some embodiments of the present disclosure.

As shown in Table 2, all of the collagen contents of Example 6, Example 7, Example 8, and Example 9 were 0.2%; the difference between the examples is that the weight-average molecular weight of the collagen was 10 KDa, 5 KDa, 2 KDa, 1 KDa, respectively. Referring to FIG. 3, which shows the results of blending process in Example 6 to Example 9. FIG. 3 shows that under the same amount of collagen, the stirring power of the molecular weight of 10 KDa (Example 6), 5 KDa (Example 7), 2 KDa (Example 8), and 1 KDa (Example 9) all exceeded the set threshold (75 W) during about 150 minutes to about 200 minutes, then stirring powers reached to 90W during about 250 minutes to about 300 minutes of the stirring time. Compared to the Example 2 to Example 4, the contents of the terminal amine group in Example 6 to Example 9 all significantly increased to about 20 meq/kg. However, there was no obvious trend in terminal group, Yellowing index, and the content of the organic matter among Example 6 to Example 9.

Adding collagen after polymerization of amide compounds (post-addition system)

In this system, amide compounds may be caprolactam, collagen may be purified from fish scale waste. The difference from the aforementioned internal addition system is that in the post-addition system, collagen is blended with polyamide 6 after polyamide 6 is formed through ring-opening polymerization of caprolactam. Specifically, caprolactam was added to a first stirring tank, and collagen was added to a second stirring tank. The temperature of the first stirring tank was adjusted to about 240° C. to about 255° C., and the pressure was adjusted to 3 bar. The second stirring tank remained at room temperature and normal pressure, it was only for preparing collagen for the subsequent blending.

When the continuous stirring in the first stirring tank lasted for about 3 to about 5 hours, the reaction reached to termination threshold (75 W of stirring power), caprolactam was ring-opened polymerized into polyamide 6. At this time, the polyamide 6 in the first stirring tank and the collagen in the second stirring tank were simultaneously fed to a dynamic mixer (INDAG) by a gear pump, and the blending time was about 5 to 10 seconds. In other words, upon the caprolactam was just polymerized into polyamide 6, the remaining temperature was about 240° C. to about 255° C., the polyamide 6 was rapidly blended with collagen in a short time (about 5 to about 10 seconds). Collagen was denatured due to the high temperature, so as the three-helix structure of the collagen unraveled. Polyamide 6 and collagen were further mixed evenly because of the stirring, and they were tightly bound to each other with hydrogen bonds.

Based on the aforementioned internal addition system, in Example 10 to Example 12 of the post-addition system, the content of collagen was 0.2 weight percent of the blend composition. The difference between Example 10 to Example 12 is that the weight-average molecular weights were 10 KDa, 5 KDa, and 2 KDa, respectively.

Table 3 below shows the experimental results of Example 10 to Example 12. All of the stirring powers during the blending process of Example 10 to Example 12 reached to over 75 W. The aspects for the threshold of the completeness of blending has described in detail above, and are omitted here for the purpose of brevity. It is noted, Example 10 to Example 12 of the post-addition system are superior to Example 1 to Example 9 of the internal addition system in Yellow indexand content of organic matter; there is a small difference between Example 10 to Example 12 in Relative viscosity and terminal amine groups. In other words, using the method of the post-addition system to blend polyamide 6 and collagen leads to products with better quality and stability and better operation of the manufacturing process. In other words, the post-addition system has excellent improvement in the yield of the product and is suitable for mass production.

TABLE 3

| example | collagen (accounts for 0.2%) | Relative viscosity | Terminal amine group (meq/kg) | Yellow index | Content of organic matter (%) |
|---|---|---|---|---|---|
| Control | — | 2.44 | 47.3 | 2.16 | 0.22 |
| Example 10 | 10 KDa | 2.43 | 48.5 | 23.56 | 0.26 |
| Example 11 | 5 KDa | 2.43 | 48.2 | 20.22 | 0.28 |
| Example 12 | 2 KDa | 2.42 | 48.1 | 19.84 | 0.23 |

Evaluation of collagen content in different addition systems

Further, the effects of the different blending ways on the collagen content of the composition were verified. In this experiment, the blend compositions of Example 6 to Example 8 of the internal addition system, and the blend compositions of Example 10 to 12 of the post-addition system, were sent to Intertek Testing Services Taiwan Ltd. and were analyzed with high performance liquid chromatography (HPLC) for more accurate quantitation of the collagen content. As shown in Table 4, all of the collagen contents of Example 6 to Example 8 of the internal addition system were less than 160 μg/g, while the collagen contents of Example 10 to Example 12 were 564 μg/g, 976 μg/g, and 704 μg/g, respectively. Accordingly, compared to the internal addition system, products manufactured by the post-addition system can maintain better collagen integrity and achieve excellent quality improvement.

TABLE 4

| Way of addition | Internal addition system | | | Post-addition system | | |
|---|---|---|---|---|---|---|
| Molecular weight of collagen | Example 6 | Example 7 | Example 8 | Example 10 | Example 11 | Example 12 |
| Content of collagen (μg/g) | ≤160 | ≤160 | ≤160 | 564 | 976 | 704 |

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

What is claimed is:

1. A method of manufacturing a blend composition, comprising:

providing caprolactam, wherein the caprolactam is in an amount of 97-99.9 parts by weight;

heating the caprolactam to a temperature of about 215° C. to about 280° C. for polymerization to form polycaprolactam; and mixing the polycaprolactam at the temperature of about 215° C. to about 280° C. with collagen, such that the collagen is denatured by heat, wherein the denatured collagen has a first polypeptide, a second polypeptide, and third polypeptide, and amide groups of the first polypeptide, the second polypeptide, and the third polypeptide are linked with amide groups of the polycaprolactam through hydrogen bond formation, thereby the blend composition is formed.

2. The method of manufacturing the blend composition of claim 1, wherein mixing the polycaprolactam at the temperature of about 215° C. to about 280° C. with the collagen comprises:

mixing the polycaprolactam at the temperature of about 215° C. to about 280° C. with the collagen, the collagen being in an amount of 0.1-3 parts by weight.

3. The method of manufacturing the blend composition of claim 1, wherein heating the caprolactam to the temperature of about 215° C. to about 280° C. for the polymerization to form the polycaprolactam comprises:

heating the caprolactam at the temperature of about 215° C. to about 285° C. and at a pressure of about 3 bars for about 3 to about 5 hours to form the polycaprolactam.

4. A method of manufacturing a blend composition, comprising:

providing caprolactam;

providing collagen, wherein the collagen is in an amount of 0.1-3 parts by weight;

mixing the caprolactam and the collagen to form a mixture; and heating the mixture to a temperature of about 215° C. to about 280° C. for polymerization of the caprolactam in the mixture to form polycaprolactam and denaturing the collagen in the mixture with heat to form denatured collagen, wherein the denatured collagen has a first polypeptide, a second polypeptide, and a third polypeptide, and amide groups of the first polypeptide, the second polypeptide, and the third polypeptide are linked with amide groups of the polycaprolactam through hydrogen bond formation, thereby the blend composition is formed.

5. The method of manufacturing the blend composition of claim 4, wherein providing the caprolactam comprises:

providing the caprolactam in an amount of 97-99.9 parts by weight.

6. A method of manufacturing a blend composition, comprising:

providing polyamide 6, wherein the polyamide 6 is in an amount of 97-99.9 parts by weight;

heating the polyamide 6 to a temperature of about 215° C. to about 280° C. to form liquid polyamide 6; and mixing the liquid polyamide 6 at a temperature of about 215° C. to about 280° C. with collagen to denature the collagen with heat, wherein the collagen is in an amount of 0.1-3 parts by weight, the denatured collagen has a first polypeptide, a second polypeptide, and a third polypeptide, and amide groups of the first polypeptide, the second polypeptide, and the third polypeptide are linked with amide groups of the liquid polyamide 6 through hydrogen bond formation, thereby the blend composition is formed.

* * * * *